428-408 SR
11/20/79 XR 4,175,022

United States Patent [19]

Vadla et al.

[11] 4,175,022

[45] Nov. 20, 1979

[54] ELECTROLYTIC CELL BOTTOM BARRIER FORMED FROM EXPANDED GRAPHITE

[75] Inventors: Jostein J. Vadla, Lewiston, N.Y.; Harold J. Wilder, Bay Village, Ohio

[73] Assignee: Union Carbide Corporation, New York, N.Y.

[21] Appl. No.: 790,652

[22] Filed: Apr. 25, 1977

[51] Int. Cl.[2] ..... B32B 9/04; B32B 15/04; C25C 9/00

[52] U.S. Cl. ..... 204/243 R; 252/378 R; 266/280; 423/448; 423/460; 428/310; 428/408

[58] Field of Search ..... 428/310, 408; 264/109, 264/123; 156/155; 266/280; 423/448, 460; 204/243 R; 252/378 R

[56] References Cited

U.S. PATENT DOCUMENTS

| | | | |
|---|---|---|---|
| 2,174,597 | 10/1939 | Pyster et al. | 266/280 |
| 2,783,195 | 2/1957 | Raynes et al. | 204/243 R |
| 2,837,412 | 6/1958 | Bennett | 423/460 |
| 3,093,570 | 6/1963 | Dewey | 266/280 |
| 3,267,183 | 8/1966 | Feinleib | 204/243 R |
| 3,404,061 | 10/1968 | Shane et al. | 423/460 |
| 3,475,244 | 10/1969 | Sanders | 423/460 |
| 3,726,738 | 4/1973 | Gellon et al. | 156/276 |
| 3,773,643 | 11/1973 | Russell et al. | 204/243 R |

FOREIGN PATENT DOCUMENTS

| | | | |
|---|---|---|---|
| 2045721 | 9/1970 | Fed. Rep. of Germany | 204/243 R |

*Primary Examiner*—John T. Goolkasian
*Assistant Examiner*—J. J. Gallagher
*Attorney, Agent, or Firm*—J. Hart Evans

[57] ABSTRACT

The thermal insulation in the bottom of an electrolytic cell for the production of metal by electrolysis of metal ore or ore derivatives is protected from attack by the corrosive elements in the electrolytic bath. The protection is provided by a layer of graphite sheet formed from expanded graphite which is placed on top of the insulation. Preferably the graphite rests on a thin steel sheet.

27 Claims, 4 Drawing Figures

ELECTROLYTIC CELL BOTTOM BARRIER FORMED FROM EXPANDED GRAPHITE

Figure 1:
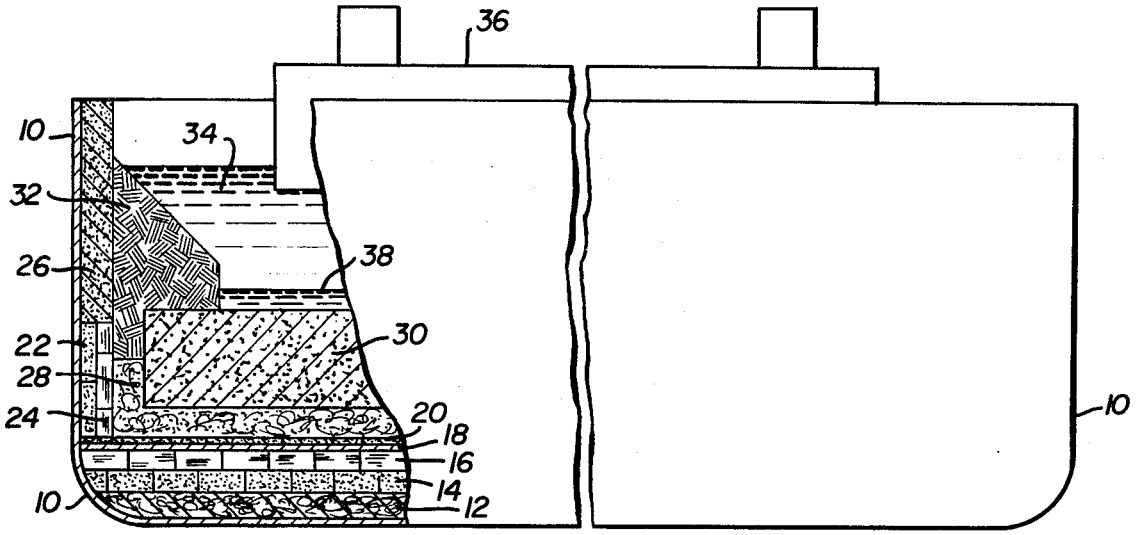
Figure 2:
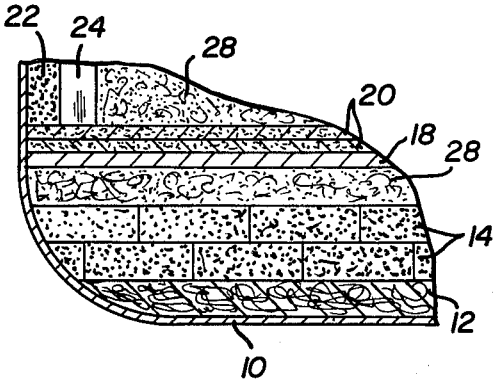
Figure 3:
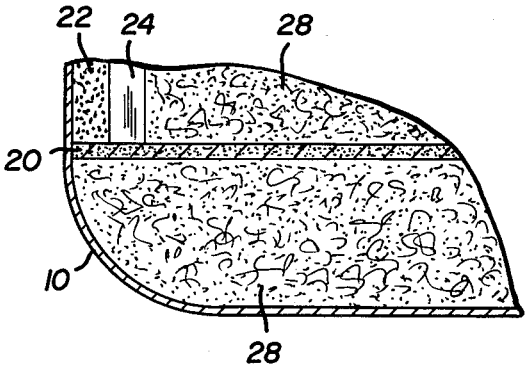
Figure 4:
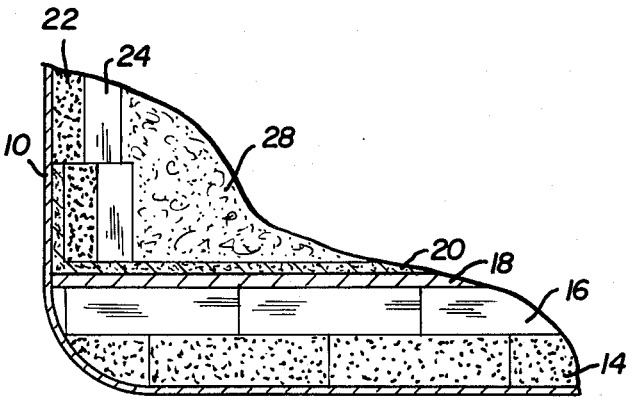

This invention relates to the construction of cells for the production of metals such as aluminum and magnesium by the electrolytic reduction of their ores or ore derivatives such as alumina and magnesium chloride. More particularly it relates to a protective barrier to be used to shield the insulation in the bottom of such cells from attack by components of the electrolytic bath.

Such electrolytic cells for aluminum production commonly consist of a steel shell with insulation on the bottom and around the sides. Such cells frequently measure about 10 feet by 30 feet and are 4 to 5 feet deep. Alumina or other suitable refractory powder is distributed over the top of the insulation in the bottom of the cell and the carbon cathode blocks are then set in the alumina. A mixture of pitch and anthracite is used to seal around the sides and ends of the cathode blocks and is then baket to solidify it. During operation of the cell current is led from the cathode through metal bus bars embedded in the bottom of the cathode blocks. Molten cryolite (sodium aluminum fluoride) is poured over the cathode blocks filling the space above them to a height of about 7 inches above the blocks. The anodes are supported from above and dip into the top of the pool of molten cryolite.

Alumina is then charged into the molten cryolite and when current is applied to the cell aluinum collects under the cryolite on top of the carbon cathode. Periodically aluminum is removed from the cell and fresh alumina is charged to it. Temperature in the electrolytic bath in the cell is maintained at about 950° C. to 975° C. and good insulation on the bottom of the cell is essential to the maintenance of uniform temperature. Various insulating materials are used, including alumina, fibers insulation, insulating brick and fire brick.

When a newly constructed cell is first heated up and operated, cracks and fissures develop in the pitch and anthracite sealer. These cracks, fissures and accompanying voids permit cryolite to pass through the pitch and anthracite layer and to eventually reach the insulation below. The molten cryolite may solidify when it first reaches the insulation but in time it will re-melt and migrate into the insulation itself. Such migration tends to degrade the physical and insulating properties of the insulation as it is attacked by the decomposition products of the cryolite such as sodium, aluminum and various flourides in both liquid and gaseous form. In addition certain other electrolytic bath constituents are quite corrosive to the insulation as well as to the steel of the shell. These include lithium fluoride and calcium fluoride, compounds which are added for particular remedial purposes during operation of the cell. Aluminum itself will tend to migrate with the bath constituents and is very undesirable in the presence of steel as it will alloy with the steel and attack it in this manner. Such degradation of the insulation makes it more and more difficult to control the temperature of the electrolytic bath in the cell and eventually the cell must be torn down and the insulation replaced, all at considerable expense. Furthermore, if the cryolite migrates completely through the insulation so as to reach the steel outer shell this shell itself is attacked and weakened.

It is highly desirable, therefore, to provide a protective barrier above the insulation which will prevent the cryolite from migrating into it. Steel itself has been proposed as a barrier material but steel, although a good barrier against sodium is attacked by many of the other constituents and by products of cryolite and the electrolytic bath. A steel barrier of practical life therefore would have to be unreasonably thick, heavy and unwieldy. Steel alone therefore is not a satisfactory or practical barrier material.

We have now found that graphite sheet material made by rolling out expanded graphite is an excellent barrier to cryolite and most of its decomposition products and the components of the electrolytic bath. When a thin sheet formed from expanded graphite is placed above the insulation in an electrolytic cell it gives excellent protection against migration of cryolite, its decomposition products and the bath components, thus providing protection against all corrosive materials likely to be encountered except for sodium. While such a graphite sheet can be used alone as a barrier we prefer to use it in combination with a thin sheet of steel placed underneath it. In this combination the graphite sheet barrier guards the steel against those constituents harmful to it and to the insulation and permits only sodium to migrate through the graphite. Sodium, however, is effectively stopped by the steel. In this manner total protection is given to the insulation by this combination.

In addition to providing an excellent barrier against migration of bath materials and corrosive elements into the insulation of an electrolytic cell, the graphite sheet formed from expanded graphite is an effective chill plate because of its anisotropic properties. Molten bath constituents reaching the graphite sheet barrier are solidified as heat is conducted by the graphite and steel barrier to the edges of the cell where the steel walls of the cell radiate and dissipate the heat. The graphite sheet is so highly thermally anisotropic that it will conduct 5 to 6 times as much heat laterally to edges of the cell as it will pass through the barrier to the insulation below. To take advantage of this property of the graphite sheet the sheet is preferably bent at right angles at the end of the cell and led up the cell wall for 8 inches or more. This insures good thermal contact with the steel cell walls. It cannot be done on the sides of the cell because of the holes through which bus bars are passed.

In the drawing:

FIG. one is a simplified side elevation of a cell configuration, with a cutaway section view at one end showing interior construction.

FIG. two is a partial section of a side elevation of a cell showing a different type of insulation and protective layer.

FIG. three is a partial section of a side elevation of a cell showing yet another type of insulation and protective layer.

FIG. four is a partial section of a side elevation of a cell showing a different construction for contacting the graphite sheet formed from expanded graphite with the wall of the cell.

In the simplified cell for aluminum production depicted in FIG. one the bus bars have been omitted for simplicity and clarity and only those elements essential to an understanding of the construction of the cell and of the invention as related to it are depicted. The steel outer shell 10 of the cell is covered on the inside bottom of the cell with layer of fibrous insulation 12. On top of this is a layer of insulating brick 14 and on top of this is a layer of fire brick 16. Above the fire brick layer 16 is a steel sheet 18 with a graphite sheet formed from expanded graphite 20 resting directly on top of the steel sheet 18. Around the inside edges of the shell 10 is stacked a layer of insulating brick 22 abutting the steel shell 10 with an inner layer of fire brick 24 resting against the insulation brick 22. On top of these bricks is a graphite member 26.

A layer of alumina powder 28 is distributed over the graphite sheet formed from expanded graphite 20 and the carbon cathode block 30 rests on the alumina powder 28. More alumina powder 28 is filled in around the sides and ends of the cathode 30 and above this is a sealing layer of baked pitch and anthracite 32. An electrolytic bath 34 composed principally of molten cryolite or sodium aluminum fluoride is poured into the cell on top of the cathode 30. A carbon anode 36 is supported from above the cell and extends down into the electrolytic bath 34. Alumina is periodically charged into the cryolite and when a current flows between the electrodes electrolysis occurs in the electrolytic bath and molten aluminum metal 38 collects on top of the cathode 30. Periodically aluminum 38 is removed from the cell as product and fresh alumina or aluminum ore is charged to the electrolytic bath 34.

In the embodiment of the invention illustrated in FIG. two, two layers of graphite sheet formed from expanded graphite are laid on top of a steel sheet 18. Under the steel sheet 18 is a layer of alumina 28 and beneath that two layers of insulating brick 14 which in turn rest on a layer of fibrous insulation 12. The outer steel shell 10 and sidewall insulating brick 22 and fire brick 24 are as in FIG. one. FIG. three illustrates an embodiment wherein a layer of graphite sheet formed from expanded graphite 20 is laid directly on an insulating bed of alumina powder 28 contained in the outer steel shell 10 of the cell. Sidewall insulating brick 22 and fire brick 24 are shown as in FIG. one.

In FIG. four is shown an embodiment of the invention wherein the graphite sheet formed from expanded graphite 20 does not terminate at the end walls of the outer steel shell 10 but instead extends up the end walls of the shell 10 for several inches. This extension provides good thermal contact between the graphite sheet formed from expanded graphite 20 and the outer steel shell 10 so that the walls of the shell 10 can radiate and dissipate the heat conducted to them by the thermally anisotropic graphite sheet formed from expanded graphite 20.

Graphite sheet suitable for use in the invention can be formed from expanded graphite by first expanding graphite particles of natural or synthetic origin by a factor of at least 80 times in the "c" crystallographic axis dimension, and then compressing the expanded particles to form a cohesive structure. The expansion of graphite particles can readily be achieved by attacking the bonding forces between layer planes in the internal structure of the graphite. The result of such attack is that the spacing between the superposed layers can be increased so as to effect a marked expansion in the direction perpendicular to the layers which is the "c" axis direction. The expanded particles can be formed under a slight pressure into a foam material since the particles have the ability to adhere without a binder due to the large expansion. Sheets and the like are formed from the expanded graphite particles by simply increasing the compressive pressures, the density of the formed graphite sheet being related to the applied formation pressures. A full description of the method of making expanded graphite and forming graphite sheets from it can be found in U.S. Pat. No. 3,404,061, issued on Oct. 1, 1968.

Whole sheets can be formed from expanded graphite with densities of from less than 5 pounds per cubic foot to about 137 pounds per cubic foot. The density range workable in the invention is from about 20 pounds per cubic foot to about 110 pounds per cubic foot. We prefer densities in the range of from 70 to 95 pounds per cubic foot. The thickness of the graphite sheet can vary over a wide range depending upon the processing conditions used. A graphite sheet formed from expanded graphite and suitable for use in the invention should have a minimum thickness of about 0.005 of an inch or 5 mils. The greatest thickness for which any practical benefit would obtained is about 60 mils. Anything thicker would be a waste of material. Our preferred operating range for the graphite sheet layer is from 15 to 25 mils. The graphite layer can be one sheet or can be several sheets and the thicknesses referred to above refer to the total layer regardless of the number of sheets used. In a prefered embodiment of the invention the graphite sheet formed from expanded graphite which is used in the protective layer has a total thickness of about 20 mils and a density of about 90 pounds per cubic foot.

The sheets of graphite formed from expanded graphite used in this invention are quite thin and consequently have low tensile strength. Accordingly to facilitate handling of the sheets and to protect their structural integrity until they are in position and covered by a layer of alumina powder or the like we prefer to adhere to the graphite sheet at the time of making a scrim or web of rayon or the like. This supportive scrim is fugitive under the operating conditions of the cell and rapidly burns off or vaporizes when the cell is heated up. By then, of course, it has served its purpose and is no longer needed. We prefer to use a monolithic single sheet of graphite for each layer in the cell. While a plurality of sheets could be used if they were overlapped or sealed together in some manner and we have in fact operated successfully with such overlapped sheets, none the less the best results will be obtained with a single sheet of the graphite. If more than one layer of graphite is used each layer should consist of a single sheet for best results.

The steel sheet in the protective layer can be quite thin as it is not under structural stress and its only purpose is to inhibit the passage of sodium which may have migrated through the graphite layer above it which protects it from all other bath ingredients. The steel sheet should be at least 5 mils in thickness to be useful in the invention, while a thickness of from 20 to 30 mils have no increased effectiveness as protective barriers although their efficiency as chill plates is increased. Such thicker sheets are heavier and more difficult to handle and may be more expensive.

With reference to aluminum production the invention has been described as applied to the modern type of cell where the cathode consists of individual blocks. The invention is equally useful however in the older type of aluminum cell where instead of such individual cathode blocks the cathode is of the so-called rammed or tamped type. In such cells a thick layer of a mixture of pitch and anthracite and sometimes coke granules is spread across the cell over a layer of alumina on top of the bottom insulation and rammed or tamped into a solid electrode surface with bus bar connections to the power source. Upon baking, such an electrode develops voids and fissures into which both components migrate. A protective layer according to the invention therefore is quite effective when placed above the bottom insulation.

For clarity and convenience, the invention has been described principally with respect to an electrolytic cell for the production of aluminum by the electrolytic reduction of alumina. The protective barrier provided by the invention however is equally useful in any electrolytic cell where protection is required against similar corrosive elements in the electrolytic bath. A particular application is in the production of magnesium from magnesium chloride and barriers according to the invention are quite useful in such cells.

The claims which follow define the invention and the inventive concept is not limited other than by the claims.

What is claimed is:

1. In an electrolytic cell, for the electrolytic reduction of metal ores, said cell having a steel shell and a lining of insulation on the bottom and sides thereof, the improvement consisting of a lining on the bottom of said shell comprising thermal insulation and a protective layer of at least one graphite sheet formed from expanded graphite on top of said insulation.

2. In an electrolytic cell, for the electrolytic reduction of metal ores, said cell having a steel shell and a lining of insulation of the bottom and sides thereof, the improvement consisting of a lining on the bottom of said shell comprising thermal insulation, a steel sheet on top of said insulation and directly resting on top of said steel sheet, a protective layer comprising at least one graphite sheet formed from expanded graphite.

3. A lining according to claim 1 wherein said thermal insulation comprises a layer of alumina.

4. A lining according to claim 1 wherein said thermal insulation comprises a layer of fibrous insulating material.

5. A lining according to claim 1 wherein said thermal insulation comprises a layer of insulating brick.

6. A lining according to claim 1 wherein said thermal insulation comprises a layer of fire brick.

7. A lining according to claim 1 wherein said thermal insulation comprises a bottom layer of fibrous insulating material, at least one layer of insulating brick on top of said fibrous insulating material, and a layer of fire brick on top of said insulating brick.

8. A lining according to claim 1 wherein the graphite sheet in said protective layer has a total thickness of from 5 to 60 mils.

9. A lining according to claim 1 wherein the graphite sheet in said protective layer has a total thickness of from 15 to 25 mils.

10. A lining according to claim 1 wherein the graphite sheet in said protective layer has a density of from 20 to 110 pounds per cubic foot.

11. A lining according to claim 1 wherein the graphite sheet in said protective layer has a density of from 70 to 95 pounds per cubic foot.

12. A lining according to claim 1 wherein the graphite sheet in said protective layer has a total thickness of about 20 mils. and a density of about 90 pounds per cubic foot.

13. A lining according to claim 2 wherein the steel sheet in said protective layer is at least 5 mils thick.

14. A lining according to claim 1 wherein the graphite sheet in said protective layer at the time it is positioned in the bottom of said shell has a reinforcing structure adhered to its top surface.

15. A lining according to claim 1 wherein the graphite sheet in said protective layer extends part way up the inside of the end walls of said steel outer shell.

16. A lining according to claim 2 wherein said thermal insulation comprises a layer of alumina.

17. A lining according to claim 2 wherein said thermal insulation comprises a layer of fibrous insulating material.

18. A lining according to claim 2 wherein said thermal insulation comprises a layer of insulating brick.

19. A lining according to claim 2 wherein said thermal insulation comprises a layer of fire brick.

20. A lining according to claim 2 wherein said thermal insulation comprises a bottom layer of fibrous insulating material, at least one layer of insulating brick on top of said fibrous insulating material, and a layer of fire brick on top of said insulating brick.

21. A lining according to claim 2 wherein the graphite sheet in said protective layer has a total thickness of from 5 to 60 mils.

22. A lining according to claim 2 wherein the graphite sheet in said protective layer has a total thickness of from 15 to 25 mils.

23. A lining according to claim 2 wherein the graphite sheet in said protective layer has a density of from 20 to 110 pounds per cubic foot.

24. A lining according to claim 2 wherein the graphite sheet in said protective layer has a density of from 70 to 95 pounds per cubic foot.

25. A lining according to claim 2 wherein the graphite sheet in said protective layer has a total thickness of about 20 mils. and a density of about 90 pounds per cubic foot.

26. A lining according to claim 2 wherein the graphite sheet in said protective layer at the time it is positioned in the bottom of said shell has a reinforcing structure adhered to its top surface.

27. A lining according to claim 2 wherein the graphite sheet in said protective layer extends part way up the inside of the end walls of said steel outer shell.

* * * * *